US010626865B2

(12) United States Patent
Bardin et al.

(10) Patent No.: US 10,626,865 B2
(45) Date of Patent: Apr. 21, 2020

(54) PLATE GEAR PUMP AND HYDRAULIC CENTERING PINS

(71) Applicant: AKWEL SA, Champfromier (FR)

(72) Inventors: Matthieu Bardin, Chatuzange le Goubet (FR); Christophe Bondran, Saint Uze (FR)

(73) Assignee: AKWEL SA, Champfromier (FR)

( * ) Notice: Subject to any disclaimer, the term of this patent is extended or adjusted under 35 U.S.C. 154(b) by 289 days.

(21) Appl. No.: 15/846,763

(22) Filed: Dec. 19, 2017

(65) Prior Publication Data

US 2018/0172001 A1 Jun. 21, 2018

(30) Foreign Application Priority Data

Dec. 20, 2016 (FR) ..... 16 70769

(51) Int. Cl.
*F04C 2/08* (2006.01)
*F04C 2/18* (2006.01)
*F04C 15/06* (2006.01)

(52) U.S. Cl.
CPC ..... *F04C 2/084* (2013.01); *F04C 2/086* (2013.01); *F04C 2/088* (2013.01); *F04C 2/18* (2013.01); *F04C 15/06* (2013.01); *F04C 2240/805* (2013.01)

(58) Field of Classification Search
CPC ..... F04C 2240/805; F04C 2/084; F04C 2/086
See application file for complete search history.

(56) References Cited

U.S. PATENT DOCUMENTS 3,128,710 A * 4/1964 Blomgren ..... F04C 2/086 418/152
3,404,633 A 10/1968 Connelly
6,991,442 B2 1/2006 Meguro

FOREIGN PATENT DOCUMENTS

DE 102011051486 A1 1/2013
DE 102011121843 A1 6/2013
WO 2012/000812 A2 1/2012

OTHER PUBLICATIONS

Mar. 21, 2017 Search Report issued in French Patent Application No. 1670769.

* cited by examiner

*Primary Examiner* — Mary Davis
(74) *Attorney, Agent, or Firm* — Oliff PLC

(57) ABSTRACT

A lightweight gear pump easy to manufacture, having a reduced manufacturing cost, while giving sufficient performances. It consists of: A gear, three metal plates, placed on each other, an intermediate plate of which including an eight-shaped cavity adapted to house the gear, and two peripheral plates having the function of enclosing the gear in the cavity, a circuit for fluid supply to the gear, centering means to align the three plates above each other, the three metal plates being provided with centering holes in the axial direction, adapted to receive the centering means, the device according to the invention is particularly intended for liquid transfer applications for automobiles or heavy trucks.

10 Claims, 4 Drawing Sheets

PLATE GEAR PUMP AND HYDRAULIC CENTERING PINS

TECHNICAL FIELD OF THE INVENTION

The invention relates to a simple gear pump. These pumps are used in particular in the automotive field or for the heavy trucks because of their ability to create high pressures for liquids.

BACKGROUND ART

Here, the term "gear pump" designates a system composed of two intermeshing toothed wheels for the propulsion of a liquid. A simple gear pump is illustrated in FIG. 1. The simple gear pump comprises two toothed wheels, which are arranged side by side in a cavity or a pump body, which is eight-shaped. The toothed wheels mesh by rotating in opposite directions relative to each other. The body comprises an inlet and an outlet for the passage of the fluid to the right of the meshing zone of the toothed wheels. The fluid is housed between the teeth of each of the wheels and the wall of the body of the pump. The fluid cannot return between the two wheels, which drive this fluid at the periphery of the cavity. The gear pump uses the combined profile of two toothed wheels to transfer and increase the pressure of the fluid.

The document U.S. Pat. No. 6,991,442 filed by Soqi Kabushiki Kaisha describes a gear pump, a section of which is illustrated in FIG. 2. The two toothed wheels 37, 38 having parallel axes of rotation 39, 41 of the gear pump are housed in a pump body or a cavity 36, which is connected to a hydraulic system comprising an oil pan 68, an oil supply means 35, pipes 62, 63, 66, 67, grooves 64 and 65, and valves 69. The chassis of the gear pump comprises three flat metal plates 48, 49, 51. These plates are placed one above the other, with the intermediate plate 49 in the middle, which includes the cavity 36 in order to house the gear pump. Screws 52, 33 releasably connect these three plates 48, 49 and 51. Furthermore, pins 53 serve as a centering in alignment holes in the three metal plates 48, 49, 51 to allow a proper alignment of the three metal plates 48, 49, 51.

The centering pins 53 are located in the peripheral zone of the part, in a dry zone outside the hydraulic circuit.

The intermediate plate 49 is machined in order to form the cavity 36 intended for the gear pump. The two other peripheral plates 48 and 51 are placed below and above the intermediate plate 49 housing the pump. The fact that the plates 48, 49 and 59 are made of metal allows obtaining a good accuracy, which ensures desired performances in terms of pressure of the fluid downstream of the pump.

Grooves and pipes for the hydraulic system are also machined in these three plates before assemblies. Thereby, one of the drawback of this pump is that the path of the fluid passes through substantially right angles, at 90°, see the marks 62 and 63, which leads to internal pressure drops. It would be possible to remedy partially this problem by machining radii or fillets, but at additional costs.

Another drawback of the hydraulic pump described in U.S. Pat. No. 6,991,442 is the eccentric location of the centering pins, which increases the bulk of the gear pump.

Moreover, a manufacturing of the hydraulic chamber made of plastic, in particular of injected thermoplastic, which is another known embodiment, does not allow obtaining the same accuracy as a metal part and leads to insufficient or irregular performances because of the dispersion of the clearances obtained during manufacture.

There are also in the state of the art pumps with components made of thermoplastic rectified with high dimensional accuracy, but these operations are very expensive.

SUMMARY OF THE INVENTION

The present invention aims in particular to solve, in whole or in part, the aforementioned problems.

For this purpose, the object of the invention is a lightweight gear pump easy to manufacture, having a reduced manufacturing cost, while giving sufficient performances.

Such a gear pump includes:

a gear, three metal plates, placed on each other, an intermediate plate of which including an eight-shaped cavity adapted to house the gear, and two peripheral plates having the function of enclosing the gear in the cavity, a circuit for fluid supply to the gear, centering means to align the three plates above each other, the three metal plates being provided with centering holes in the axial direction, adapted to receive the centering means, the gear pump being characterized in that the intermediate plate is provided with openings enabling said fluid supply circuit between the centering holes and the eight-shaped cavity, the pump also comprising:

a first flange made of plastic material adapted to receive the three metal plates and including a pipe for the inlet and the outlet of the fluid of the gear, a second flange made of plastic material including the centering means adapted to align the centering holes in the three plates, these centering means being adapted to at least partially form said fluid circuit with the cavity housing the gear and the inlet and outlet pipe in the first flange, and fastening means to fasten the first flange to the second flange in order to enclose the three metal plates.

Such a pump includes a hydraulic chamber made with standard metal sheets of calibrated thicknesses, which are for example made of stainless steel, cold-rolled and having an accuracy class sufficient to guarantee the pressurization performance and to control the dispersion of the performances between the different manufactured pumps.

In such a gear pump, the hydraulic chamber is constituted from an intermediate plate including a cavity to receive the gear, two flanges are placed on either side of the intermediate plate, and the three plates are made from only cut rolled steel sheets of calibrated thickness, without resuming the machining in thickness.

The parts integrating the hydraulic conduits of the pump are injected with plastic material, in a gear pump thereby; the inlet and outlet fluid circuit of the fluid is constituted by a part made of injected plastic material.

This configuration easily allows the production of radii in the elbows of the hydraulic pipes, thus reducing the pressure drops as well as the mass of the pump assembly.

In such a gear pump, the toothed wheels may also be made by injection of plastic material.

Indeed, the accuracy provided by the cut metal plates, allows accepting a lower accuracy of the gears made of plastic material. The production of a thermoplastic gear also contributes to the mass reduction.

BRIEF DESCRIPTION OF THE DRAWINGS

The present invention will be well understood and its advantages will emerge in the light of the following description, given only by way of non-limiting example and made with reference to the appended drawings, in which.

DETAILED DESCRIPTION

Figure 1:
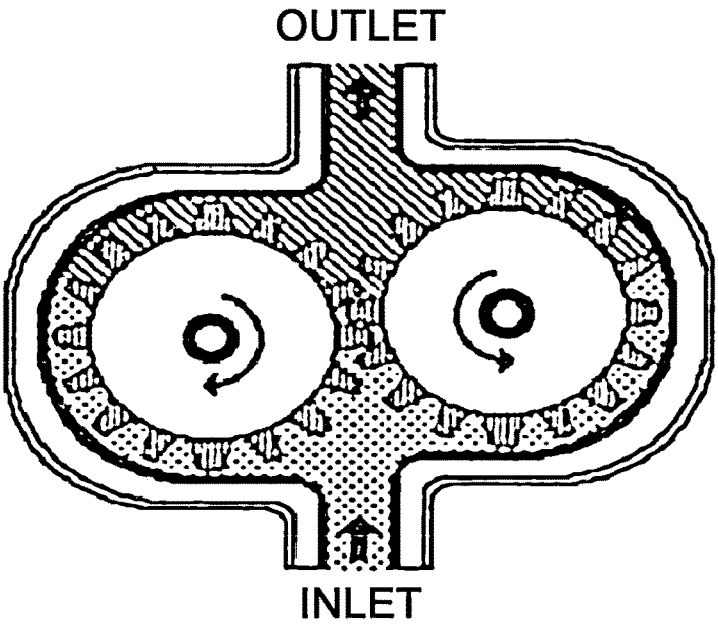
Fig. 1 PRIOR ART
FIG. 1 shows a diagram of an already described simple gear pump.
Figure 2:
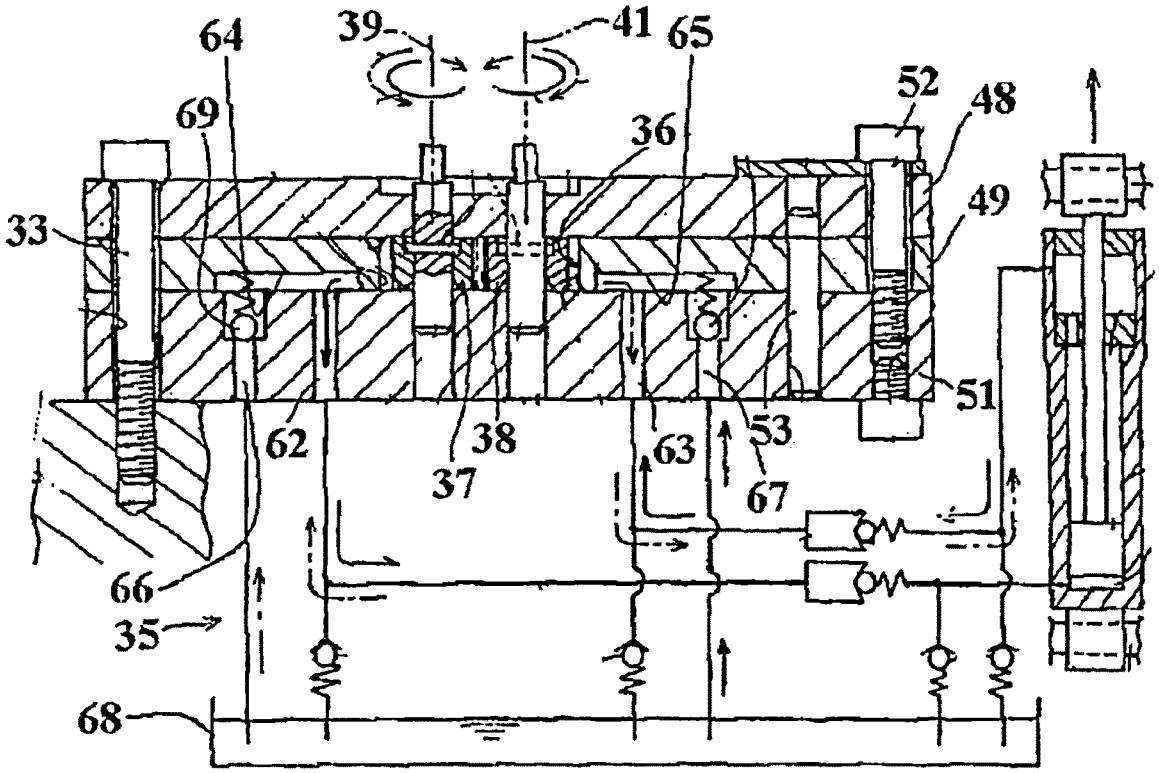
Fig. 2 PRIOR ART
FIG. 2 shows a section of an already described gear pump according to the state of the art.
Figure 3A:
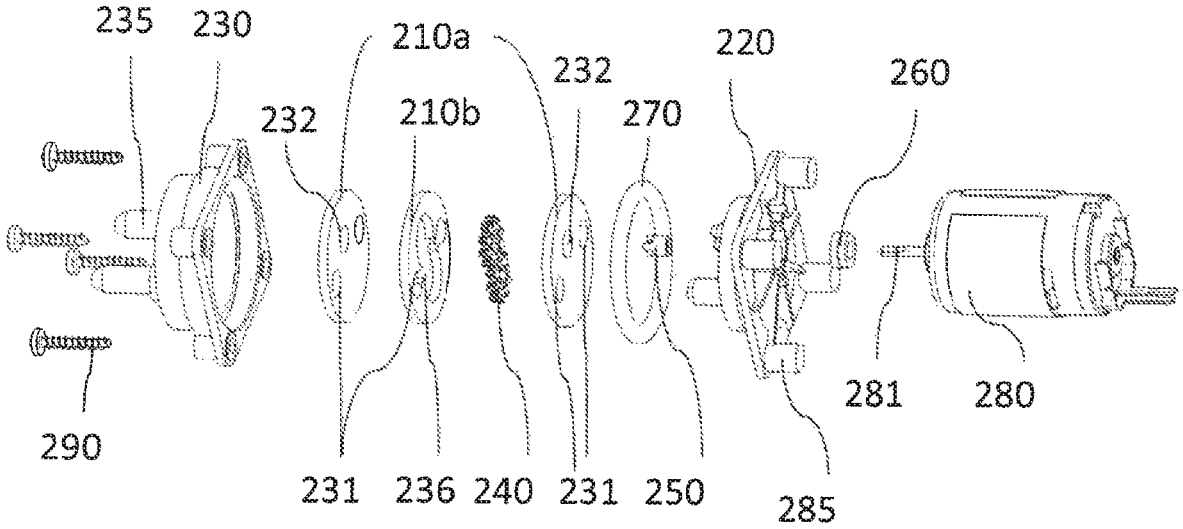
FIG. 3*a* shows an exploded perspective view of the gear pump according to the invention and a motor to which it is connected.

The invention will now be explained in more detail using the appended drawings in which:

FIG. 3*a* shows an exploded perspective view of the different parts of the gear pump and the motor thereof. A plate 210*b* includes an eight-shaped cavity 236 adapted to house a gear 240 and two centering pin housings 231. The metal intermediate plate 210*b* is also provided with a communication channel (FIG. 4*c*, 405) between the cavity 236 and each of the housings 231. Two identical peripheral metal plates (210*a*) include two centering pin housings 231 and an opening 232 whose axis is coincident with the axis of one of the wheels of the gear 240, when the pump is mounted. In the drawings, the three plates are circular, but they might have another shape as well, such as an elliptical, square, or rectangular shape. These plates are dimensionally accurate and made in a particularly simple manner because they are manufactured without any operation of adjusting in thickness, for example, made of cold-rolled stainless steel sheet of «Fine (F)» accuracy according to the standard 1509445. According to the latter standard, a plate of 2 mm thickness has a tolerance of 41-0.035 mm on the thickness. The outer contour of the plates 210*a*, 210*b* can be made, in particular, in fine cutting or stamping. The cutting of the cavity 236 may be performed with the required accuracy, in standard wire electrical discharge, namely a dimensional accuracy of ±0.01 mm on the different dimensions of the cut, for a dimension of about 25 mm and for flanges of 2 mm thickness. The housings 231 and 232 may be cut more economically, in fine cutting, with an accuracy of ±0.05 mm for a diameter of about 8 mm. A stamping cut may also be considered for the housings 231 and 232, if provided that the deformations remain acceptable. It should be noted that the relative position of the cavity 236 and the housings 231 can be made very accurate thanks to their successive production using the same method such as, for example the wire electrical discharge, and can allow a positioning of the cuts there between with an accuracy in the order of ±1.5 μm. The mentioned cutting methods are common and inexpensive. The considered design therefore allows obtaining a hydraulic chamber of a pump provided with a good dimensional accuracy on both the thickness, the flatness and the accuracy of the diameters. For ease of manufacture, the three plates may be of the same thickness, but it might be considered to have, for example, the plates 210*a* made in a thickness smaller than the thickness of the plate 210*b*, to reduce the mass of the pump.

Figure 3B:
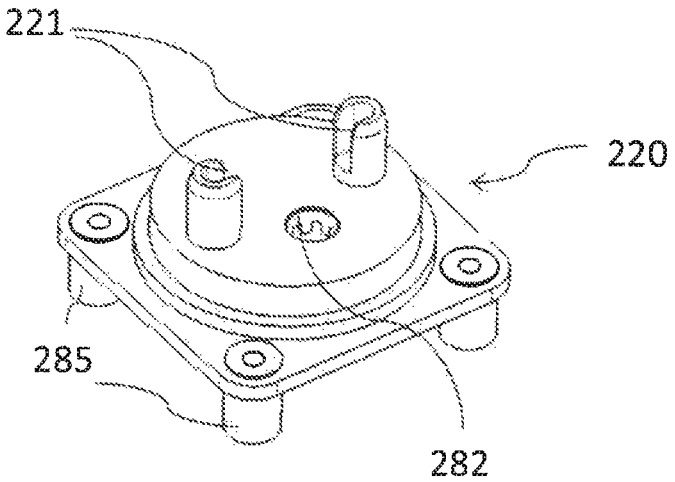
FIG. 3*b* shows a perspective view of a flange and the hydraulic centering pins of the gear pump according to the invention.

A first flange 230 made of plastic material includes, on one side, a space adapted to house the three metal plates 210*a* and 210*b* and, on the other side, hydraulic inlet and outlet pipes 235. A second flange 220 also illustrated in perspective in FIG. 3*b*, is adapted to carry a motor 280 on one side, and is, on the other side, provided with two centering pins 221, also ensuring the piping function of the fluid at the pump inlet and outlet, thus constituting «hydraulic centering pins». The second flange 220 is also provided with an axial hole 282 for the passage of the axis 281 of the motor 280. The second flange 220 is provided with means, here four studs 285, intended to receive the assembly screws of the pump. A coupling 250 has the function of connecting in rotation the axis 281 of the motor 280 to one of the wheels of the gear 240. The centering pins 221 have a flared shape and are part of the hydraulic circuit. The centering pins 221 close the hydraulic space on one side and their inner shape allows a fluid communication between the inlet and outlet pipes 235 of the first flange 230 and the cavity 236 of the gear 240. The centering pins 221 thus have the double function of aligning the three metal plates and forming the hydraulic circuit of the gear pump. The fact that the flanges 230 and 220 are made of plastic material allows an optimum arrangement of the parts constituting the hydraulic circuit in order to reduce the pressure drops in an optimum manner in the hydraulic circuit. Indeed, the shape of the channels inside the pins 221 may be easily made with radius shapes reducing the pressure drop, because these channels are made with the flange 220 by injection of plastic material. Furthermore, the production of flanges and toothed wheels with thermoplastic materials selected, for example, from polyphtalamides, polyetherimides, polysulfones, polyoxymethylenes, polyamides, allows the construction of a particularly lightweight pump. The dimensional accuracy required for the flanges 220 and 230, is only a common accuracy, because the flanges have only a function of assembling and containing vis-a-vis the metal plates. Thus, the manufacture of these flanges 220, 230 may be carried out economically.

The motor 280 is provided with an axis 281 and has the function of transmitting the torque thereof to one of the wheels of the gear 240 via a coupling 250. The axis of the motor 280 is adapted to pass through the axial hole 282 in the second flange 220. In this embodiment, the first flange 230 is connected to the second flange 220 by four screws 290. The screwing allows clamping the three metal plates together and against the two flanges 220, 230. The sealing of the hydraulic circuit is guaranteed by the screwing of these screws 290 as well as by the surface state and the flatness of the metal plates. Those skilled in the art understand that other means can be used to obtain the same effect as the screwing, for example, an assembling by welding or a snap fitting of the flanges 220, 230. A first seal 270, for example an O-ring, can be placed between the first flange 230 and the second flange 220 and a second seal 260 on the axis 281 of the motor in order to guarantee the sealing of the hydraulic circuit vis-à-vis the medium external to the pump and vis-à-vis the motor 280. It should be noted that the driving in rotation of one of the wheels of the gear 240 can be carried out by any means other than a brushed direct current motor as represented, for example, a «brushless» motor and that, according to the considered rotational driving means, the seal 260 might or might not be necessary.

Figure 4A:
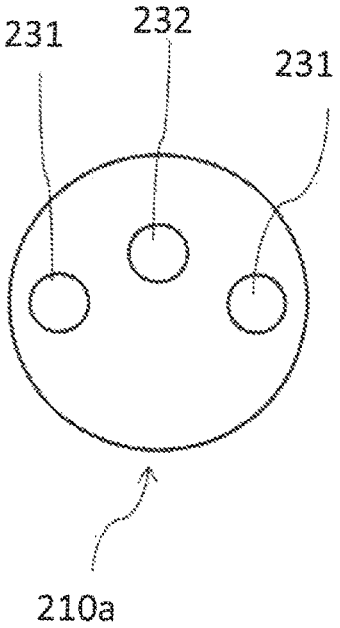
FIGS. 4*a*, 4*b* and 4*c* show plan views of the metal plates according to a first embodiment of the cuts.

FIG. 4*a* shows a first peripheral metal plate 210*a* provided with three holes. Two holes 231 located diametrically opposite to each other about the central axis of the plate 210*a* are adapted to receive the centering pins 221. The third hole 232 is intended to receive the axis 281 of the motor 280. The holes 231 and 232 can be made, preferably, in fine cutting as seen previously.

Figure 4B:
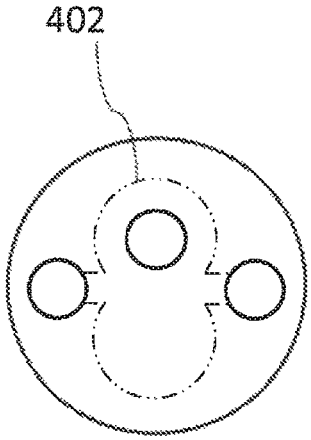
Figure 4C:
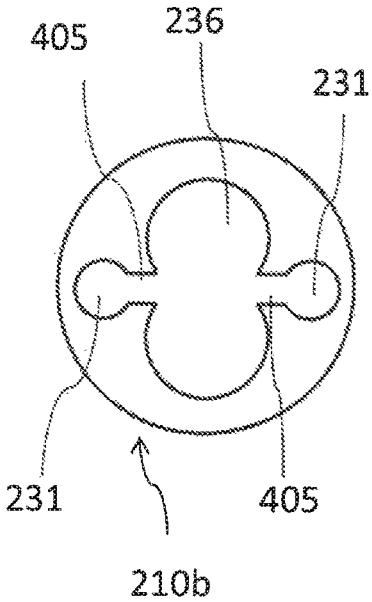

In FIG. 4*b*, on the peripheral plate 210*a*, the eight-shape of the cavity intended for the gear 240 is drawn, the axis of one of the lobes of the eight being coaxial with the hole 232 and with the axis of one of the toothed wheels of the gear 240. Then, an arm is drawn which connects the holes 231 by passing between the two lobes of the eight, that is to say the line along which the teeth of the wheels cling to each other. By cutting the plate 210*a* along this drawing 402, the intermediate plate 210*b* is obtained, which includes a cavity 236 intended to house the gear 240, the two holes 231 intended to the centering pins 221 and two channels 405 which allow a fluid communication between the cavity 236 and the flared portion of the centering pins 221 when said centering pins are housed in the centering holes 231. Using a peripheral plate 210*a* as a blank to manufacture the intermediate plate intended to house the gear, the manufacturing method becomes more efficient and a good accuracy is obtained. It may be considered, for example, to make the first three holes 231 and 232 in fine cutting, then to make the cutting according to the drawing 402 by wire electrical discharge, a method known to give high accuracy, as previously seen, and necessary for a good pump performance.

Figure 5A:
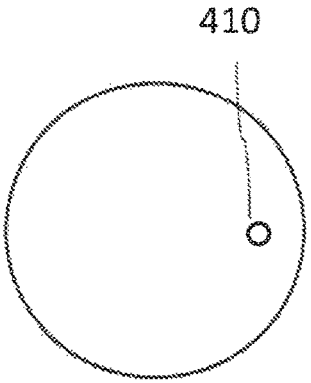
FIGS. 5*a*, 5*b*, and 5*c* show plan views of the metal plates according to a second cutting mode.
Figure 5B:
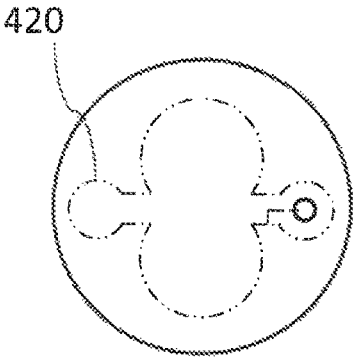
Figure 5C:
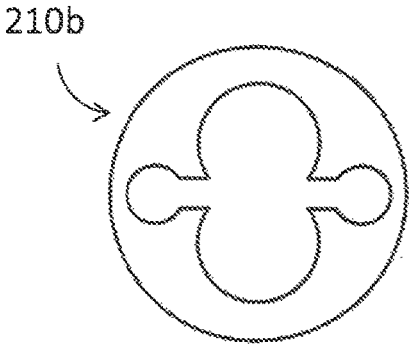

FIGS. 5*a*, 5*b* and 5*c* show another embodiment of the cut of the plate 210*b*. In this case, the plate is cut entirely according to the cutting pattern 431, starting from a pilot hole 410, which allows passing, and an electrical discharge wire. This embodiment gives a greater accuracy of carrying out the cutting than the embodiment described in the paragraph above, in FIG. 5*c*, the flange is made entirely in cutting by wire electrical discharge, which is more accurate than the thin cutting.

Figure 6A:
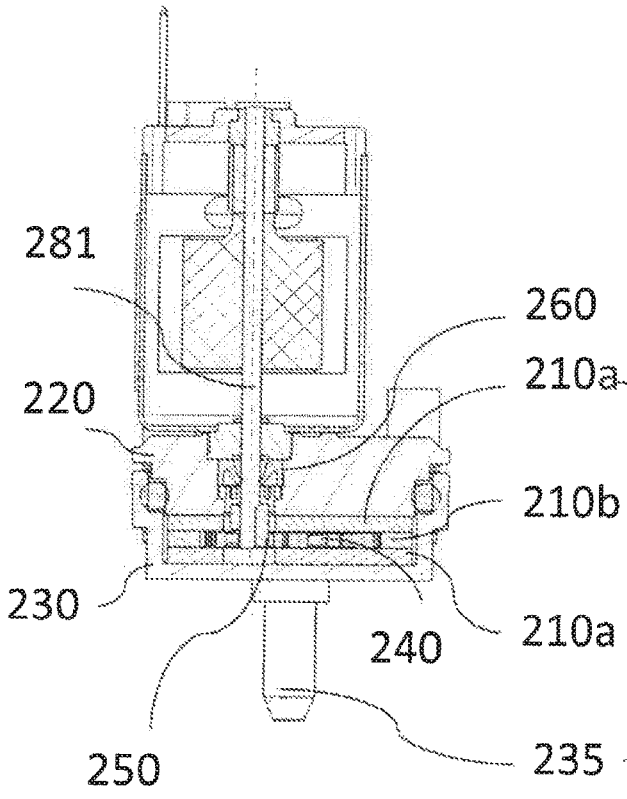
FIG. 6*a* shows a section passing through the motor axis of the gear pump.

FIG. 6*a* shows the axis 281 of the motor 280 which passes through a dedicated hole in the second flange 220 and one of the peripheral plates 210*a* and which is connected to one of the toothed wheels of the gear 240 which is housed in the cavity 236 of the intermediate plate 210*b*. The three plates are laid on each other and housed in the first flange 230.

Figure 6B:
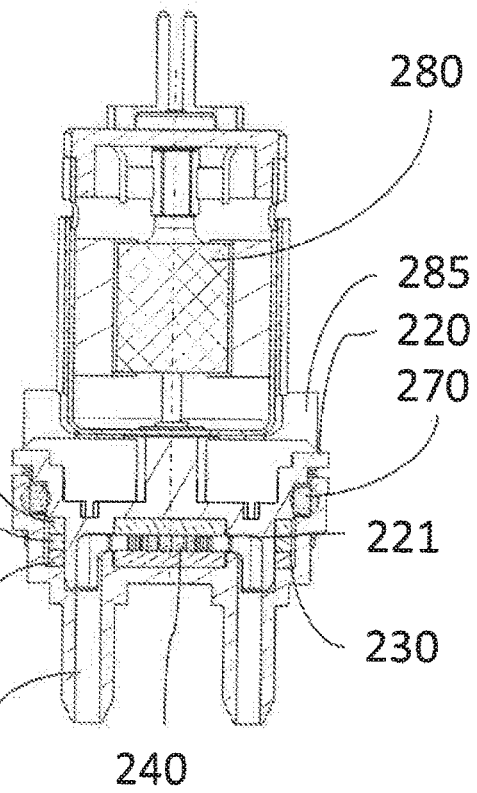
FIG. 6*b* shows another section of the gear pump passing through the axes of the hydraulic conduits constituting the fluid circuit.

FIG. 6*b* illustrates how the centering pins 221 of the second flange 220 ensure the dual function of aligning the three metal plates 210*a*, 210*b*, 210*a* in the first flange 230, and of creating a closed fluid circuit between the inlet and outlet pipes 235 and the cavity 236 which houses the gear 240. A seal 270 ensures the fluidic sealing between the first flange 230 and the second flange 220. Those skilled in the art understand that there are other means for obtaining a sealing between the first and second flanges. The motor 280 rests on the second flange 220 between the studs 285. The motor 280 is secured to the second flange 220 by a means not shown in the FIG.s. Those skilled in the art understand that it is possible to connect the motor to the hydraulic part of the gear pump in a different way.

A first advantage of integrating the centering pins into the hydraulic circuit is a bulk reducing of the gear pump.

A second advantage of integrating the centering pins into the hydraulic circuit is that elbows in the hydraulic pipe may be removed and thus the pressure drop of the gear pump is reduced, as indicated above.

A third advantage of integrating the centering pins into the hydraulic circuit is a reduction in the volume of the metal parts and thereby a reduction in weight of the gear pump.

By housing the metal plates in plastic flanges, the weight of the pump is reduced for a given performance.

A variant even lighter than the described invention, and not represented, consists in using only one metal plate 210*b*. The cavity 236 is then closed above and below the plate 210*b*, respectively by the flange 220 and the flange 230. The plastic flanges used as a support for the gear do not however allow obtaining the same accuracy as when using three metal plates.

A second variant, not represented, consist in superimposing two metal plates, the first of which has in its thickness, the digging of an eight-shaped cavity having the function of a peripheral lower plate and the intermediate plate, while the second plate has the function of an upper peripheral plate. This variant has the drawback of an expensive complex machining, and giving a level of dimensional accuracy less than the described solution.

It is also possible to form the cavity of the gear using two identical plates each provided with a hollow space of the shape of the cavity intended for the gear which are laid one above the other. The two superposed plates then reconstitute a cavity corresponding to the thickness of a single plate 210*b*. This variant also has the disadvantage of an expensive and complex machining, and giving a level of dimensional accuracy less than the described solution.

The invention claimed is:

1. A gear pump including a gear, three metal plates that are stacked on each other, comprising of: an intermediate plate of which including an eight-shaped cavity adapted to house the gear, and two peripheral plates having the function of enclosing the gear in the eight-shaped cavity, a fluid circuit for fluid supply to the gear, centering means to align the three metal plates to each other, the three metal plates being provided with centering holes in the axial direction, adapted to receive the centering means, the gear pump being characterized in that the intermediate plate is provided with openings enabling said fluid circuit between the centering holes and the eight-shaped cavity, the pump also comprising:

a first flange made of plastic material adapted to receive the three metal plates and including a respective pipe for the inlet and the outlet of the fluid of the gear, a second flange made of plastic material including the centering means extends thru the centering holes to align the three metal plates, these centering means being adapted to at least partially form said fluid circuit with the eight-shaped cavity housing the gear and the inlet and outlet pipe in the first flange, and fastening means to fasten the first flange to the second flange in order to enclose the three metal plates.

2. The gear pump according to claim 1, wherein the three metal plates being made from only cut rolled steel sheets of calibrated thickness.

3. The gear pump according to claim 1, wherein the gear comprising two toothed wheels that are made by plastic material injection.

4. The gear pump according to claim 3, comprising a seal between the first flange and the second flange having the function of guaranteeing the sealing of the fluid circuit.

5. The gear pump according to claim 1, wherein at least one of the peripheral metal plates surrounding the intermediate metal plate comprises an axial opening adapted to receive an axis of a motor connecting one of two wheels of the gear to the motor.

6. The gear pump according to the claim 5, wherein the gear comprises two wheels, where one wheel is connected at the wheel's axis of rotation to the motor axis in order to transmit the torque to the gear in order to rotate the two wheels of the gear pump.

7. The gear pump according to the claim 6, wherein the axis of the motor being provided with a seal.

8. The gear pump, according to claim 1, wherein the eight-shaped cavity intended for the gear being cut by wire electrical discharge.

9. The gear pump according to claim 1, wherein the centering holes are made by fine cutting.

10. The gear pump according to claim 1, wherein a peripheral plate serving as a blank for manufacturing the intermediate plate.

* * * * *